US006065320A

United States Patent [19]

Thieven et al.

[11] Patent Number: 6,065,320

[45] Date of Patent: May 23, 2000

[54] CALIBER CONTOUR IN A ROLLING MILL ROLLER FOR TUBES

[75] Inventors: Peter Thieven, Aachen; Winfried Braun, Düsseldorf, both of Germany

[73] Assignee: Mannesmann AG, Düsseldorf, Germany

[21] Appl. No.: 09/051,360

[22] PCT Filed: Sep. 27, 1996

[86] PCT No.: PCT/DE96/01881

§ 371 Date: Apr. 8, 1998

§ 102(e) Date: Apr. 8, 1998

[87] PCT Pub. No.: WO97/13595

PCT Pub. Date: Apr. 17, 1997

[30] Foreign Application Priority Data

Oct. 11, 1995 [DE] Germany ..... 195 39 408

[51] Int. Cl.[7] ..... B21B 39/20

[52] U.S. Cl. ..... 72/252.5

[58] Field of Search ..... 72/224, 226, 234, 72/235, 368, 367.1, 366.2, 51, 52; 492/28, 30

[56] References Cited

U.S. PATENT DOCUMENTS 3,952,570 4/1976 Demney et al. ..... 72/224
4,099,402 7/1978 Biller ..... 72/234

FOREIGN PATENT DOCUMENTS 24 48 158 4/1976 Germany .

*Primary Examiner*—Rodney A. Butler
*Attorney, Agent, or Firm*—Cohen, Pontani, Lieberman & Pavane

[57] ABSTRACT

The invention relates to a groove contour of the substantially circularly grooved rolls of a reducing mill with three-high rolling stands, especially for rolling thick-walled tubes with a wall thickness/diameter ratio greater than 0.25. According to the invention, the groove contour of each roll (1) has a diameter enlargement (5) in the region of the groove base in which the material rolled in the roll discontinuity of the particular preceding groove in the roll direction can be formed.

3 Claims, 1 Drawing Sheet

CALIBER CONTOUR IN A ROLLING MILL ROLLER FOR TUBES

BACKGROUND OF THE INVENTION

1. Field of the Invention

The invention relates to the groove contour of the substantially circularly grooved rolls of a reducing mill with three-high rolling stands, especially for rolling thick-walled tubes with a wall thickness/diameter ratio greater than 0.25.

2. Discussion of the Prior Art

In order to roll thin-walled tubes, reducing mills according to the prior art normally do not use circular groove forms. Instead, such reducing mills use elliptical grooves formed by three curvatures, the short semiaxes of which are located in the groove base. The long semiaxis is located in the groove discontinuity and is larger than the short semiaxis of the preceding groove. This measure represents an attempt to prevent the rolled material from emerging into the roll gap and in this way to avoid roll gap markings. However, the technical limits of such groove forms are reached in rolling tubes with wall thickness ratios greater than 0.1. In these cases, so-called "polygon formation" occurs, i.e., the internal contour of the tube deviates from the desired circular shape. In an extreme case, such polygon formation can result in an almost hexagonal internal cross-section, which severely limits the usefulness of the tube.

It is nearly impossible to roll thick-walled tubes using the known oval grooves. Instead, grooves that are more nearly circular in shape and can better suppress polygon formation must be used. These correlations are discussed in the "Archive of Iron and Steel Metallurgy" (Archiv fuer das Eisenhuettenwesen), Vol. 41, No. 11, November 1970, pp. 1047–1053. In conclusion, this known prior art proposes that reducing mills use special grooving for the thick-walled portions of the program of a tube rolling train. The special grooving strives to encompass the tube on all sides during the rolling process, i.e., to achieve a substantially circular groove. It is possible to adopt such a measure because roll gap markings are significantly less likely to appear on the external surfaces of thick-walled tubes than on those of thin-walled tubes. The groove opening should be selected so the difference in length between the shortest and longest contact areas is minimal, i.e., in such a way as to create a rectangular contact surface between the roll and the tube.

When the principle stated in the cited publication is applied, however, it has been shown that an even contact surface cannot be achieved between the tube and the roll in pass sequences with small groove openings. Using standard roll pass dressing technology, a contact surface with three peaks, which are located in the groove base and at the groove discontinuities, respectively, is created. This is described on p. 1052, FIG. 11 of the aforementioned publication. In very thick-walled tubes with a wall thickness/diameter ratio greater than 0.25, the peaks in the contact surface between the roll and the rolled material again result in internal non-circularities on the tube and thus have a significant negative impact on tube quality. Furthermore, friction is increased, so that the rolls abrade more intensely.

SUMMARY OF THE INVENTION

Starting from the prior art as described in "Archive of Iron and Steel Metallurgy," Vol. 41, No. 11, November 1970, discussed above the present invention is based on the object of improving the groove contour of rolls with substantially circular grooving according to the prior art in such a manner that undesired peaks in the contact surface between the roll and the rolled material are avoided or at least flattened.

To attain this object, according to the invention the groove contour of each roll has, in the region of the groove base, a diameter enlargement, in which it is possible to deform the material rolled in the roll discontinuity of the preceding groove in the direction of roll.

By deliberately enlarging the groove diameter in the region of the groove base, it is possible to shorten the contact length in this region, and thus to obtain an even contact surface. As a result, the tube is no longer subjected to disproportionate stresses in the region of the groove base, because the distinct peaks found in the prior art can largely be flattened.

It is particularly advantageous for the diameter enlargement, starting from the groove diameter, to equal approximately 0.5% to 1.0% of the groove diameter and to extend on both sides of the groove base center at a circumferential angle of roughly 10° to 15°. Given these dimensions, good tube results have been obtained, i.e., a nearly right-angled contact area between the roll and the rolled material.

In another embodiment of the invention, in addition to the diameter enlargement in the groove base of the roll, a diameter enlargement is provided in the region of the groove discontinuity. This latter diameter enlargement can be achieved, for example, by enlarging the transition radius at the edge of the roll to 3–5 mm. It has been shown that when such radii (which are less than 3 mm in the prior art) exist, significant improvement in deformation ratios can be achieved and the groove contact peaks can be significantly reduced even at the edge of the groove of a roll.

BRIEF DESCRIPTION OF THE DRAWINGS

An example of the invention is shown in the drawings and described below. The drawings show.

DETAILED DESCRIPTION OF THE PREFERRED EMBODIMENTS

Figure 1:
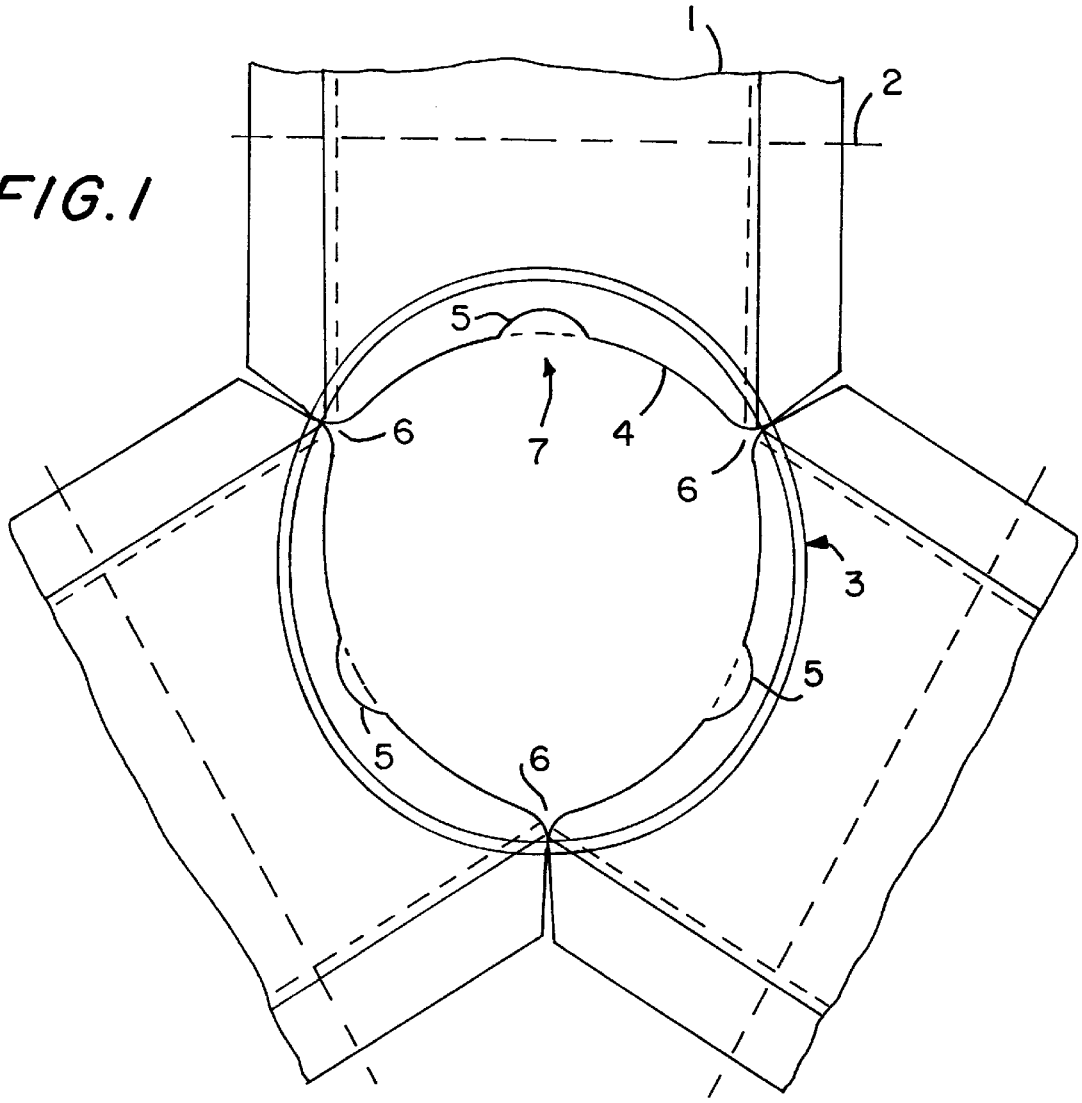
FIG. 1 is a front view of a partially-cut grooved roll according to the invention with a tube that is entering.
Figure 2:
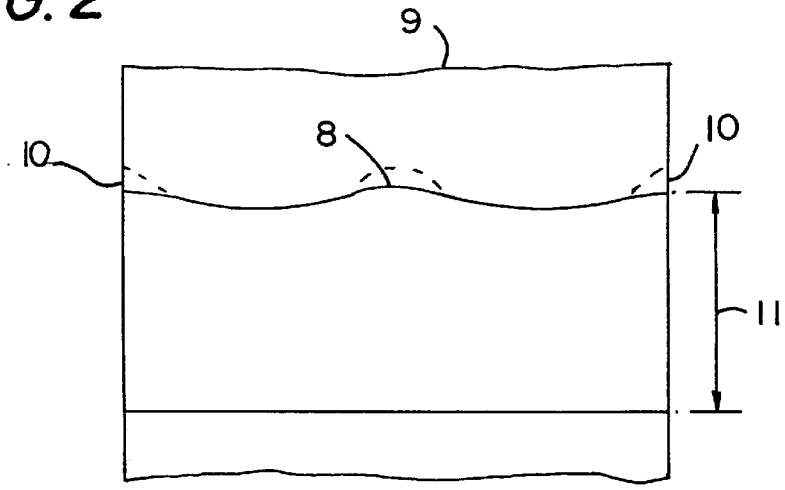
FIG. 2 is a plan view projection of the contact area between the tube and the grooved roll according to the invention.

In FIG. 1, reference number 1 indicates one of three grooved rolls according to the invention that comprise the total groove. The indicated grooved roll 1 rotates around the rotational axis 2. The tube to be rolled is marked with reference number 3. The substantially circular groove 4 of the roll 1 has, in the region of the groove base, an enlarged diameter 5, i.e., a deepening of the groove base. According to the invention, there are further 1 groove enlargements 6 in the region of the groove discontinuity at 6; specifically, in the form of radii enlargements at the edge of the grooved roll 2. To assist understanding, FIG. 1 shows the conventional groove form by a dashed line 7. The conventional groove form is also shown in FIG. 2, which depicts the projection of the contact area between the tube 3 and the roll 1. The contact peaks created in the conventional groove at 8 in the region of the groove base 9 of the grooved roll 1 and in the area of the groove discontinuity 10 on both edge sides of the roll 2 are clearly visible. These peaks 8 and 10 are created on the entry side of the roll 2 and result in the described internal non-circularity in the finished tube 3.

The contact area of the tube with the roll according to the invention is shown in FIG. 2 in a darker shade. It is clear that the peaks 8 and 10 are largely eliminated, resulting in an almost rectangular contact area with the contact length 11. The diameter enlargements 5 (in the groove base) and 6 (in the area of the groove discontinuity) are responsible for this change in contact area.

What is claimed is:

1. A groove contour of substantially circularly grooved rolls of a reducing mill with three-high rolling stands, for rolling thick-walled tubes with a wall thickness-to-diameter ratio greater than 0.25, the groove contour of each roll having a diameter enlargement in a region of a base of the groove, so that a material area of a tube rolled in a region between two neighboring rolls is deformed in the diameter enlargement in a next subsequent roll in the rolling direction.

2. A groove contour as defined in claim 1, wherein the groove has a diameter, the diameter enlargement starting from the groove diameter, equal approximately 0.5% to 1.0% of the groove diameter and extends on both sides of a center of the groove base at a circumferential angle of approximately 10° to 15°.

3. A groove contour as defined in claim 1, and further comprising a diameter enlargement in a region of a groove discontinuity in addition to the diameter enlargement in the groove base of the roll.

* * * * *